United States Patent [19]

Cameron

[11] Patent Number: 4,497,527

[45] Date of Patent: Feb. 5, 1985

[54] SUPPLEMENTARY FORCE HEAT-RECOVERABLE CONNECTING DEVICE

[75] Inventor: John K. Cameron, Fremont, Calif.

[73] Assignee: Raychem Corporation, Menlo Park, Calif.

[21] Appl. No.: 430,556

[22] Filed: Sep. 30, 1982

[51] Int. Cl.[3] ..... H01R 13/20

[52] U.S. Cl. ..... 339/30; 339/DIG. 1

[58] Field of Search ..... 339/30, DIG. 1; 411/909

[56] References Cited

U.S. PATENT DOCUMENTS

| | | | |
|---|---|---|---|
| 3,740,839 | 6/1973 | Otte et al. | 339/30 X |
| 4,022,519 | 5/1977 | Hill | 339/30 |

FOREIGN PATENT DOCUMENTS

| | | | |
|---|---|---|---|
| 53745 | 11/1981 | European Pat. Off. | 339/30 |
| 1234303 | 3/1960 | France | 339/30 |
| 1395601 | 5/1975 | United Kingdom | 339/30 |
| 1519766 | 8/1978 | United Kingdom | 339/30 |

*Primary Examiner*—William R. Briggs

*Attorney, Agent, or Firm*—James W. Peterson

[57] ABSTRACT

A connecting device which includes a socket member having at least two tines, the tines having an unstrained configuration from which at least one of the tines can be resiliently deformed away from the other tine to define a socket for receiving and holding a substrate, and a band of heat recoverable metal defining a driver member which in its martensitic phase loosely surrounds the tines so that at least one of the tines can be resiliently deformed outwardly when defining the socket member without deforming the driver member. The driver member when warmed to a temperature at which the metal is in its austenitic phase, recovers inwardly and exerts a supplementary inward force on the tines at least when the substrate is held in the socket. In the martensitic phase of the metal, the tines alone hold the substrate within the socket with sufficient force to provide a physical connection.

9 Claims, 4 Drawing Figures

SUPPLEMENTARY FORCE HEAT-RECOVERABLE CONNECTING DEVICE

FIELD OF THE INVENTION

This invention relates to connecting devices having a heat recoverable member. More particularly, this invention relates to heat recoverable connecting devices which have at least two members acting in concert such that the heat recoverable member provides a supplementary force for making strong electrical and physical connections.

BACKGROUND OF THE INVENTION

Electrical connections have, until recently, largely depended upon traditional methods such as soldering and crimping to effect the connection of, for example, conductors and cable screens. Widely used connection methods also have included pin and socket connectors as well as nut and bolt connectors.

In particular applications, it is necessary to employ reusable devices. While traditional pin and socket devices are generally considered to be reusable, the strength of the resulting physical and electrical connection is not sufficient for many applications. A soldered connection typically provides sufficient electrical continuity, however it is often not reusable because of its physical location or the heat sensitivity of closely proximate components. Additionally, a soldered connection may break down as a result of the operating conditions encountered in particular applications. Nut and bolt connections can come loose and are difficult to use in close quarters. While crimping devices generally have sufficient physical strength, they too are not generally reusable. Therefore, there is a recognized need for a reusable connecting device which can provide high electrical conductivity as well as a strong physical connection with another object, especially in environments over 200° C. and under high vibration conditions.

Recently, heat recoverable metals have been used in reusable connecting devices such as those disclosed in U.S. Pat. Nos. 4,022,519 ('519) and 3,740,839 ('839) the disclosures of which are both incorporated herein by reference. As set forth in '519 and '839, heat recoverable metals are usable for connecting devices. Basically, these heat recoverable metals are alloys which exhibit the shape memory effect. An article made from heat recoverable metal can be reversibly deformed after being cooled to near or below its martensitic transition temperature $M_s$ (the temperature at which transformation begins). If the metal is so deformed and subsequently warmed above its austenitic transition temperature $A_s$ (the temperature at which the metal starts to revert back to austenite) the heat recoverable metal recovers toward its original configuration. The recovery ends at $A_f$ (the temperature at which the transition to austenite is complete).

The device of '839 is a reusable connecting device which utilizes a heat recoverable metallic band disposed about a resilient member, such as the tines of a forked member. The tines are spaced from one another so that they can be moved inwardly, but when so moved, exert an outward force. When it is desired to make a connection between the device and other objects, the band is warmed to a temperature sufficient to cause the metal to transform to its austenitic phase. The band then shrinks with a force sufficient to overcome the opposing force of the tines, such that the tines are moved inwardly, toward one another to contact and hold an object between them. The device is reusable in that when the temperature of the band is lowered sufficiently to cause the metal to transform to its martensitic phase, the opposing force of the tines overcomes the yield strength of the band, thereby outwardly expanding the band and allowing the object placed between the tines to be released.

The device of '519 also discloses a reusable connector. The connector includes a heat recoverable metallic band disposed about a non-resilient, deformable member, typically a hollow cylinder that has been slotted to form tines. When it is desired to make a connection between the device and other objects, the band is lowered to a temperature sufficient to cause the metal to transform to its martensitic phase. The object is inserted between the tines, forcing the tines and consequently the band in its martensitic phase to be expanded outwardly. To secure the connection, the band is warmed to a temperature sufficient to cause the metal to transform to its austenitic phase. The band contracts and drives the tines towards their original configuration, thereby engaging the object. The connector is reusable in that upon lowering the temperature of the band sufficient to cause a martensitic phase transformation of the metal, the band relaxes sufficiently to allow the object to be removed from the connector by deforming the deformable member.

The device of the instant invention, unlike the devices of '519 and '839, is capable of creating a contact force with a substrate regardless of the temperature and hence phase of the heat recoverable metal, sufficient to provide a physical connection and preferred electrical continuity to the connection. The instant invention accomplishes the above through the use of resiliently deformable tines which grip a substrate with sufficient force to provide a physical connection which in the case of conductive tines provides electrical continuity, regardless of the temperature and hence phase of a heat recoverable metal band defining a driver member which surrounds the tines. However, at the $A_s$ temperature, the driver member begins to contract and above the $A_f$ temperature it has contracted sufficiently to supplement the force of the tines against the substrate.

SUMMARY OF THE INVENTION

It is an object of the present invention to provide a reusable connecting device which is capable of forming and maintaining an electrical contact of high conductivity in a high temperature, high vibration environment.

It is a further object of this invention to provide a reusable connecting device which includes both a heat recoverable member and a resiliently deformable socket member, whereby the socket member provides sufficient force to electrically contact and physically hold a substrate, regardless of the phase (corresponding to temperature) of the heat recoverable member.

These and other objects of the invention, which will become more apparent hereinafter, are achieved by the use of a resiliently deformable socket member having at least two permanently, inwardly biased tines capable, in the case of conductive tines, of independently electrically contacting and holding a substrate and a band of heat recoverable metal defining a driver member surrounding the tines. As the driver member is warmed through its $A_s$ temperature, it recovers and contracts, thereby supplementing the force of the tines in contact with the substrate. When the metal is cooled through its $M_s$ temperature, the driver member relaxes and the tines of the socket member alone hold the substrate. The substrate may then be removed from the tines. When the driver member is warmed again through its $A_s$ temperature, the driver member again contracts, thereby supplementing the force of the tines and securely connecting the substrate and the device sufficient to enable the connection to be maintained at high temperature and high vibration.

The instant invention provides and maintains relatively high electrical conductivity connection at relatively high temperatures, e.g. up to 260° C. For example, when the driver member was made from a nickel/titanium/copper alloy, the electrical conductivity of the connection was measured at 32% at 260° C. In the preferred embodiment, the force of the connection has proven to be stable for over 1000 hours.

Preferably, the driver member is made from a recently developed family of alloys disclosed in copending and commonly assigned U.S. application Ser. No. 355,274 which is incorporated herein by reference. The preferred alloy has an $M_s$ temperature of 70° C. at an applied stress of 20,000 psi and an $A_s$ temperature of 50° C. Thus, under ambient air conditions, approximately 25° C., the driver member fits loosely around the socket member. When a substrate is inserted between the tines of the socket member, the device similar to a standard electrical contact. As the driver member is warmed through its $A_s$ temperature, e.g., by the operating temperatures of an airplane engine, the driver member contracts driving the tines into engagement with the substrate. As the driver member is cooled through its $M_s$ temperature, e.g., by the cessation of operation of an airplane engine, the driver member relaxes and the substrate may be removed.

Preferably, the tines include a distal end defining an annular groove in which the driver member is located. Since, during the martensitic phase the driver member fits loosely around the tines, it is advantageous to securely locate the driver member on the socket member.

These and other objects and advantages of the instant invention will be more fully appreciated from the following description of the preferred embodiments of the invention as illustrated in the accompanying drawing.

DETAILED DESCRIPTION OF THE PREFERRED EMBODIMENT

Figure 1:
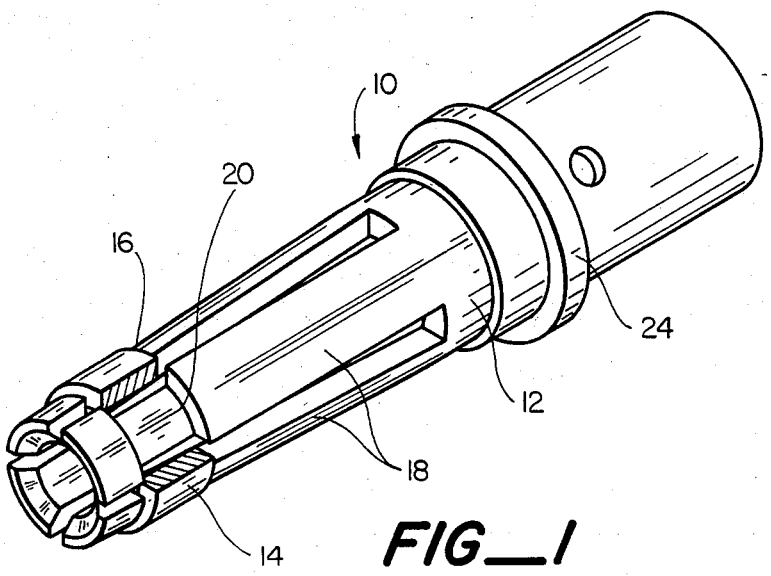
FIG. 1 is a partially cross-sectioned perspective view illustrating the preferred embodiment of the heat recoverable supplementary force connecting device in accordance with this invention.
Figure 2:
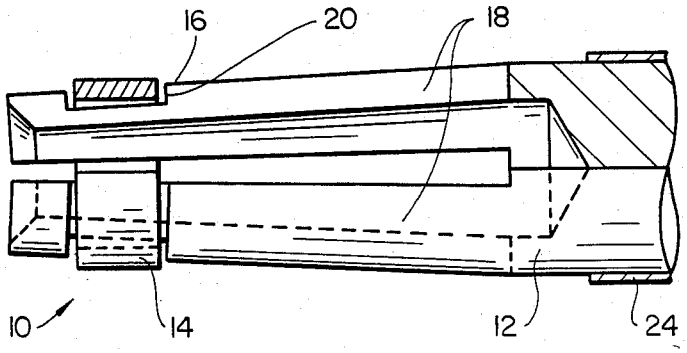
FIG. 2 is a partially cross-sectioned view of the device of FIG. 1.

With reference to the drawing, wherein like referenced characters designate like or corresponding parts throughout the views and referring particularly to FIGS. 1 and 2, there is shown the instant invention, a heat recoverable supplementary force connecting device, generally indicated by the numeral 10. The device includes a socket member 12 and a band of heat recoverable metal defining a driver member 14.

Figure 3:
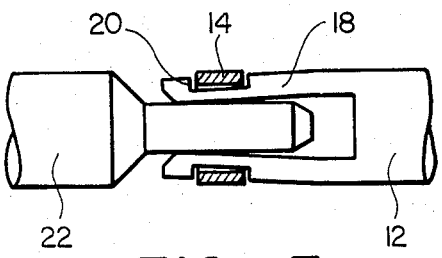
FIG. 3 illustrates in schematic form, a mating pin inserted in the connecting device of the instant invention before heat recovery.
Figure 4:
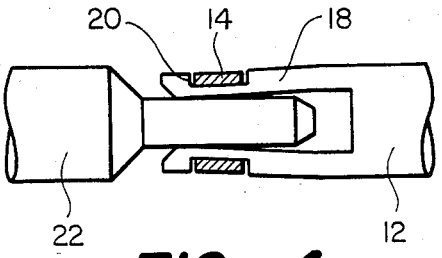
FIG. 4 illustrates in schematic form, the connecting device of FIG. 3 after heat recovery.

The socket member 12 is resiliently deformable and electrically conductive. Typically, the socket member is made from copper alloy and it is preferably made from alloy 7021*. The socket member 12 includes a at least two fork members defining tines 18. The tines 18 have an unstrained configuration from which at least one of them may be resiliently deformed away from the other to define a socket for receiving and holding mating pin 22 as seen in FIGS. 3 and 4. The tines are inwardly disposed beyond their original configurations such that they have a permanent inward set. The inside diameter of the socket member 12 at the distal end 16 is less than the outside diameter of a substrate, such as mating pin 22 illustrated in FIGS. 3 and 4. As will be discussed in more detail below, there is sufficient force exerted by the tines 18 on a substrate to physically hold the substrate within the tines without the aid of the driver member 14. The copper alloy preferably has a tensile yield strength of 60 KSI. The distal end 16 defines an annular groove 20 in which the driver member 14 is located. It is understood that it is within the scope of the invention to fabricate the socket member from a non-electrically conductive material such that the socket will still hold a substrate such as a mating pin with sufficient force to provide a physical connection.

*Made by Anaconda Wire and Cable Co.

The driver member 14 is a band of heat recoverable metal having a first original heat recovered phase known as the austenitic phase and a second relaxed phase in which the metal may be expanded known as the martensitic phase. The driver member is capable of undergoing a transformation between the phases. Specifically, the driver member 14 may be diametrically expanded when the metal is in its martensitic phase so that the driver member 14 loosely surrounds the tines 18 of the socket member 12. When the driver member 14 is warmed to a temperature at which its metal is in the austenitic phase the driver member 14 will recover inwardly to exert a supplementary inward force on the tines 18. A number of different shape memory alloys may be used for making the driver member. For example, the driver member may be made from any of the alloys described in U.S. Pat. No. 3,740,839 as well as those described in U.S. Pat. No. 3,753,700 which are both incorporated herein by reference.

In the preferred embodiment the driver member is made from a shape memory alloy having the following composition: 49 atomic percent Ti, 41 atomic percent Ni and 10 atomic percent Cu. This composition has a $M_s$ temperature of 70° C. at an applied load of 20 KSI, and an $A_s$ temperature of 50° C. under no applied load. The driver member 14 in its austenitic phase has a tensile yield strength of at least 60 KSI when made from this material. Additionally, the driver member is capable of spontaneous expansion as it changes to martensite. In other words, the driver 14 undergoes expansion (i.e., a spontaneous increase in diameter) as it goes to the martensitic phase without assistance from the tines 18. This phenomenon is the result of the two-way shape memory effect caused by repeated cycling through the transformation temperature. The spontaneous expansion is recovered when the alloy contracts during subsequent heating back to the austenitic phase. A more detailed explanation of the above is found in *Treatises in Metallurgy* edited by J. F. Tien and J. F. Elliott, 1981, in the chapter titled "Fundamentals of Martensitic Reaction" by M. Cohen and C. M. Wayman. This chapter is incorporated herein by reference.

It is also understood that more than one driver member (not shown) may be employed to provide multiple levels of supplementary force corresponding to the different metal transformation temperatures that may be utilized for each respective driver member.

After the tines 18 have been permanently set inwardly, the driver member 14 is placed over the tines 18. As a result of the normal elastic nature of the tines 18, they will ordinarily partially spring back. Before the driver member 14 is placed over the tines a means for holding the tines completely closed is desirable to prevent this partial spring back and to facilitate the initial placement of the driver member to its correct position around the tines 18 and in groove 20.

The drawing, particularly FIGS. 2–4, shows the driver member 14 as not resting on any portion of the tines 18. As a practical matter, however, the driver member 14 will, by force of gravity or through movement of the device, rest upon and lightly contact some portion of the tines 18. Regardless of such contact, the tines 18 can be resiliently deformed outwardly to define the socket without deforming the driver member.

With particular reference to FIGS. 3 and 4, there is shown a schematic representation of the device 10 in accordance with this invention connected to a mating pin 22, before and after heat recovery. FIG. 3 illustrates the operation of the device before heat recovery and FIG. 3 illustrates the operation after heat recovery. As can be seen, as a mating pin 22 is inserted within the device 10, tines 18 are expanded outwardly and do so without contacting the driver member 14 since the driver member fits loosely around the tines 18 in the annular groove 20.

FIG. 4 illustrates the device at or above the $A_s$ temperature. As illustrated in FIG. 4, as the driver member 14 is warmed to its austenitic temperature, the driver member 14 recovers and shrinks diametrically, increasing the force exerted by the tines on the mating pin 22. It is very difficult to remove pin 22 from the device 10 without cooling. However, cooling the driver member 14 to a temperature at which its metal is in the martensitic phase causes the diameter of the driver member 14 to increase spontaneously allowing the mating pin 22 to be removed since the only force holding it in the socket results from the inward set of the tines 18.

With particular reference to FIG. 1 there is seen the device 10 having a proximal end 24 defining a termination area. In some applications this may prove to be quite useful for terminating cable by crimping, soldering or other appropriate methods as desired.

While the instant invention has been described by reference to what is believed to be the most practical embodiments, it is understood that the invention may embody other specific forms not departing from the spirit of the invention. It should be understood that there are other embodiments which possess the qualities and characteristics which would generally function in the same manner and should be considered within the scope of this invention. The present embodiments therefore should be considered in all respects as illustrative and not restrictive, the scope of the invention being limited solely to the appended claims rather than the foregoing description and all equivalents thereto being intended to be embraced therein.

I claim:

1. A reusable connecting device comprising:

a socket member having at least two tines, at least one of said tines capable of being resiliently deformed away from another tine to define a socket for receiving and holding a substrate with sufficient inward force to provide a physical connection; and at least one driver member composed of heat-recoverable metal capable of being expanded in the martensitic phase and recovering in the austenitic phase, said driver loosely surrounding the tines of the socket member when the metal of the driver member is in its martensitic phase, allowing at least one of said tines to be resiliently deformed to define said socket member without further expanding said driver member, the driver member capable of instantaneous inward recovery when the metal of the driver member is in its austenitic phase to exert additional uniform inward force on the tines, said driver member capable of maintaining stable mating contact characteristics with a substrate that may be inserted within the socket.

2. A device as in claim 1 further including a substrate which may be inserted into said socket, wherein warming of the driver member to a temperature at which its metal is in the austenitic phase contracts the driver member exerting supplementary inward force on the tines to tightly grip the substrate.

3. A device as in claim 2, wherein cooling the driver member to a temperature at which its metal is in the martensitic phase allows removal of the substrate.

4. A device as in claim 3 wherein the driver member is made from a heat recoverable metal alloy exhibiting two-way shape memory effect; cooling of the driver member spontaneously increasing the diameter of the driver member allowing removal of the substrate.

5. A reusable connecting device as set forth in claim 1 wherein the driver member is made from a heat recoverable metal alloy exhibiting two-way shape memory effect, cooling the driver member to a temperature at which its metal is in the martensitic phase spontaneously increasing the diameter of the driver member allowing removal of a substrate.

6. A reusable connecting device as set forth in claim 5 wherein the socket member is made from copper alloy having a at least tensile strength of 60 KSI.

7. A reusable connecting device as set forth in claim 6 wherein the driver member is made from memory metal alloy having an $M_f$ above 25° C.

8. A reusable connecting device as set forth in claim 6 wherein the driver is made from a nickel/titanium/-copper alloy member having an austenitic tensile yield strength of at least 60 KSI in the temperature range where the supplementary force is required.

9. A reusable connecting device as set forth in claim 1 wherein the socket member has a distal end defining an annular groove in which the driver member is located.

* * * * *